US005940917A

United States Patent [19]

Wilson et al.

[11] Patent Number: 5,940,917

[45] Date of Patent: Aug. 24, 1999

[54] ADJUSTABLE METAL HAUNCH FORM FOR BRIDGE BUILDING

[76] Inventors: Richard D. Wilson, 4832 W. Villa Maria Dr., Glendale, Ariz. 85308; Ronnie L. Allen, 13038 W. Southern, Avondale, Ariz. 85323

[21] Appl. No.: 08/911,005

[22] Filed: Aug. 14, 1997

[51] Int. Cl.[6] ..... E04G 13/02

[52] U.S. Cl. ..... 14/77.1; 14/77.3; 249/28; 249/48; 249/188

[58] Field of Search ..... 14/73, 77.1, 77.3, 14/78; 249/23, 28, 48, 50, 188

[56] References Cited

U.S. PATENT DOCUMENTS

| | | | |
|---|---|---|---|
| 1,199,095 | 9/1916 | Meister | 249/48 |
| 1,553,427 | 9/1925 | Baker | 249/28 |
| 3,626,648 | 12/1971 | Beckham | 14/77.1 X |
| 3,782,680 | 1/1974 | Hopkins | 249/188 |

*Primary Examiner*—James A. Lisehora
*Attorney, Agent, or Firm*—Warren F. B. Lindsley

[57] ABSTRACT

The subject matter relates to adjustable metal haunches for use in bridge building which haunches are poured at grade level atop the stem wall at the same time as the stem wall is poured.

5 Claims, 3 Drawing Sheets

ADJUSTABLE METAL HAUNCH FORM FOR BRIDGE BUILDING

BACKGROUND OF THE INVENTION

This invention provides a means for significantly reducing material and labor costs for the construction of post tension box girder bridges. More particularly, the invention comprises an adjustable metal form which permits the pouring of concrete haunches at grade level atop the stem wall, the haunches being poured at the same time as the stem walls. The reusable haunch forms are then removed together with the stem wall forms, after which the lost deck panels are installed with their ends supported directly upon the concrete haunches known as ledgers after pouring.

DESCRIPTION OF THE PRIOR ART

The prior art construction method employs 4×4 lumber haunches supported at the top of the stem wall by metal hangers. The ends of the lost deck panels rest upon the 4×4 haunches which are adjusted to grade level using wedges between the hangers and the undersides of the 4×4 haunches. The 4×4 haunches, the hangers and the wedges are unrecoverable and the labor costs involved in the mounting and adjustment of the wooden haunches are considerable.

SUMMARY OF THE INVENTION

In accordance with the invention claimed, an adjustable metal haunch form is provided for use in the construction of post tension box girder bridges wherein the metal form permits the pouring of concrete haunches atop the stem walls at the same time the stem walls are poured. The concrete haunches known as ledgers after pouring are integral with the stem walls employed for the support of lost deck panels upon which the road bed is poured.

It is, therefore, one object of this invention to provide a haunch form for use in the forming of concrete lost deck support haunches at the tops of stem walls incorporated in post tension box girder bridges.

Another object of this invention is to provide a lost deck haunch form that permits the pouring of concrete haunches known as ledgers after pouring atop the stem walls, the haunches being integral with the stem walls and poured simultaneously with the pouring of the stem walls.

A further object of this invention is to provide a lost deck haunch form that is readily adjustable to grade level during its installation at the top of the stem wall forms.

A still further object of this invention is to provide a reusable haunch form that is removed together with the stem wall forms and is suitable for repeated use.

A still further object of this invention is to provide such a haunch form in a configuration that permits the mounting of the form at the top of the stem wall with a very minimum of hardware.

Yet another object of this invention is to provide such an adjustable and reusable haunch form together with an associated construction method which very significantly reduces material and labor costs of post tension box girder bridge construction.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings in which.

DESCRIPTION OF THE PREFERRED EMBODIMENT

Figure 1:
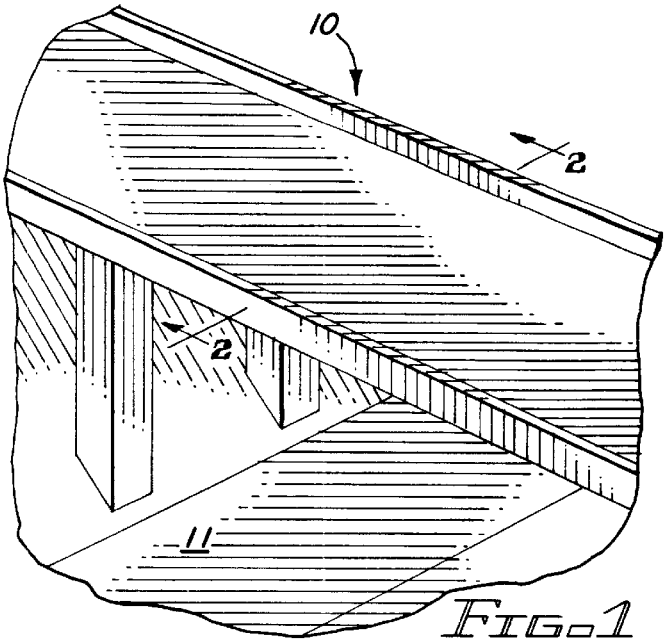
FIG. 1 is a perspective view of a box girder post tension bridge of the type that may be constructed with the use of the adjustable metal haunch form of the present invention.

Referring more particularly to the drawings by characters of reference, FIG. 1 shows the basic structure of a post tension box girder bridge 10 which in the illustration serves as an overpass for a highway 11 that passes underneath.

Figure 2:
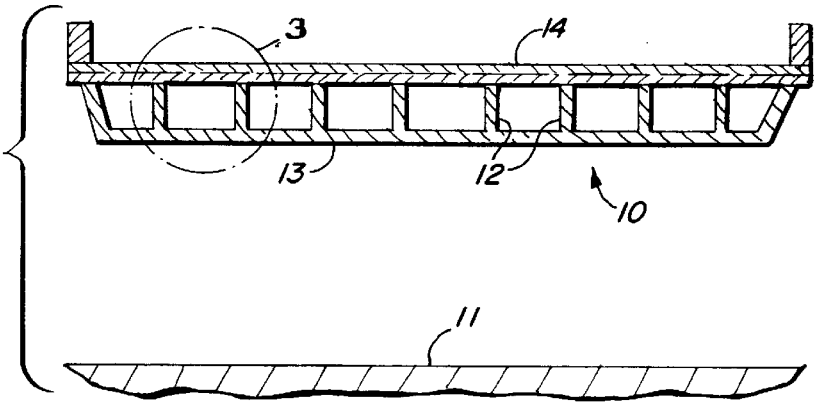
FIG. 2 (PRIOR ART)
FIG. 2 is a cross-sectional view taken along line 2—2 of FIG. 1.

The internal structure of the bridge 10 as shown in the cross-section of FIG. 2 comprises a grid or honeycomb of parallel stem walls 12 aligned lengthwise with the bridge 10. The bases of the stem walls rest upon and are integral with the bottom bridge deck 13, and the road bed 14 is supported atop the stem walls.

Figure 5:
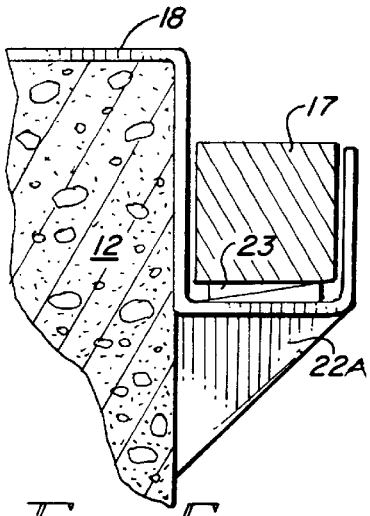
FIG. 5 (PRIOR ART)
FIG. 5 is an enlarged cross-sectional view of the prior art wooden haunch of FIG. 3 illustrating the use of wedges to adjust the haunch elevation to grade level.
Figure 3:
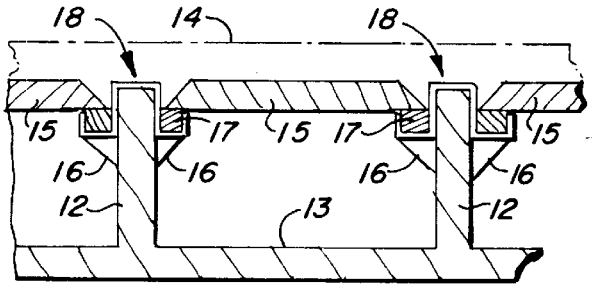
FIG. 3 (PRIOR ART)
FIG. 3 is an enlargement of area 3 of FIG. 2 showing a bridge under construction using a prior art wooden haunch as the support for lost deck panels.
Figure 4:
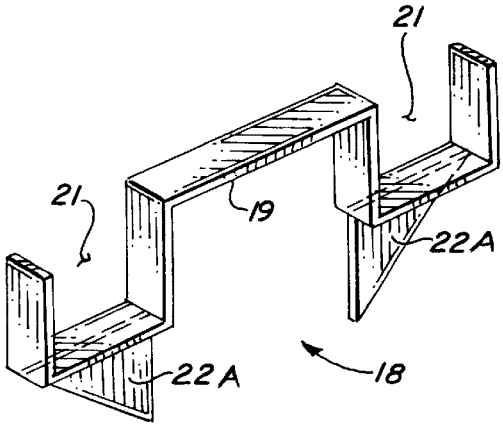
FIG. 4 (PRIOR ART)
FIG. 4 is a perspective view of a metal hanger that is used to support the 4×4 wooden haunch in the prior art method of FIG. 3.

The merits of the present invention are most readily appreciated as seen from the perspective of the prior art, as illustrated in FIGS. 3, 4 and 5.

The prior art construction of the bridge is illustrated in the enlarged cross-sectional view of FIG. 3 which shows wooden forms or "lost deck panels" 15 in place between adjacent stem walls for the pouring of the road bed 14.

The lost deck panels are supported at their ends by wooden haunches 16 in the form of 4×4 beams 17 supported alongside the upper ends of the stem walls 12 by metal hangers 18.

As shown in the perspective view of FIG. 4, the hanger 18 is formed from a steel strap with a center portion 19 that fits over the top of the stem wall. The hanger 18 is bent vertically downward at the opposite edges of the stem wall. It then bends horizontally outward and vertically upward to form a pocket 21 at each side of the stem wall which serves as a cradle for the support of the 4×4 beam as shown most clearly in FIG. 5. The dimensions of the pockets 21 are tailored to receive the beam 17 snugly and securely. A triangular metal gusset 22A at the underside of the pocket 21 braces the pocket to insure adequate support for the beams 17, and the lost deck panels 15. The lost deck panels, which are roughly eight feet square, support the freshly-poured concrete road bed until the concrete has cured. To provide adequate support for the combined weight of the wooden haunches, the lost deck panels and the uncured concrete, significant numbers of metal hangers 18 are required at relatively close intervals along the lengths of the wooden haunches 16.

In the construction of the bridge 10, the stem walls 12 and the bottom bridge deck 13 are first poured and allowed to set up. After the bridge deck forms and the stem wall forms have been removed and the wooden haunches have been put in place, it is necessary to adjust the haunches to grade level. This is accomplished by inserting wedges 23 between the undersides of the 4×4 beams 17 and the supporting faces of the hangers 18. Concrete is then poured over the lost deck panels to form the road bed 14. This leaves the wooden haunches including the 4×4 beams 17 and the metal hangers 18 trapped under the poured concrete where they remain, together with the lost deck panels 15, for the life of the bridge.

An important objective of the present invention is to eliminate the high cost associated with the unrecoverable materials, i. e. the 4×4 lumber and the metal hangers, as well as to reduce very significantly the labor costs involved in providing support for the lost deck panels.

A first embodiment of the invention is illustrated in FIGS. 6–9.

Figure 6:
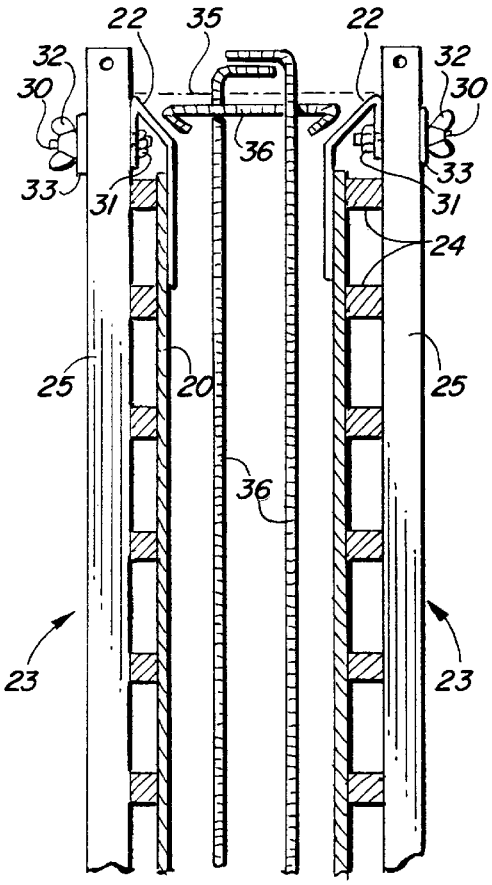
FIG. 6 is a cross-sectional view showing the adjustable metal haunch form of the invention in place together with the stem wall forms in readiness for pouring the stem wall and the concrete haunch in a single pour.

The cross-sectional view of FIG. 6 shows two adjustable metal haunch forms 22 of the invention in place together with the stem wall forms 23 in readiness for the pouring of the stem walls and integral concrete haunches.

Figure 8:
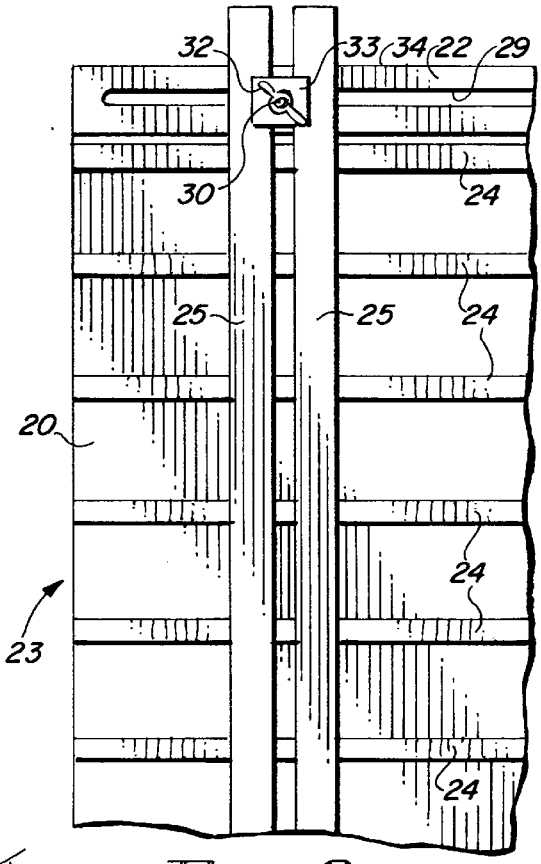
FIG. 8 is a side view of FIG. 6 as seen in the direction of arrow 8.

As shown in FIGS. 6 and 8, the stem wall form 23 comprises a sheet of ⅝ inch plywood 20 backed up by a grid of horizontal and vertical beams or "stiffbacks", 24 and 25, respectively. The horizontal stiffbacks 24 are typically 4×4 wooden beams and the vertical stiffbacks 25 are typically 4×6 or 4×8 wooden beams. Each form is perhaps eight feet wide and its height is tailored to the height of the stem wall. The horizontal stiffbacks are spaced apart 10 to 16 inches while the vertical stiff backs are stationed in pairs with perhaps two pairs provided for an eight foot wide stem wall form. The two members of each pair are positioned apart approximately ¾ inches. One pair of vertical stiffbacks is positioned inboard from one end of the stem wall form a distance equal approximately to ¼ the width of the stem wall form and the other pair is positioned the same distance inboard from the other end of the stem wall form.

Figure 7:
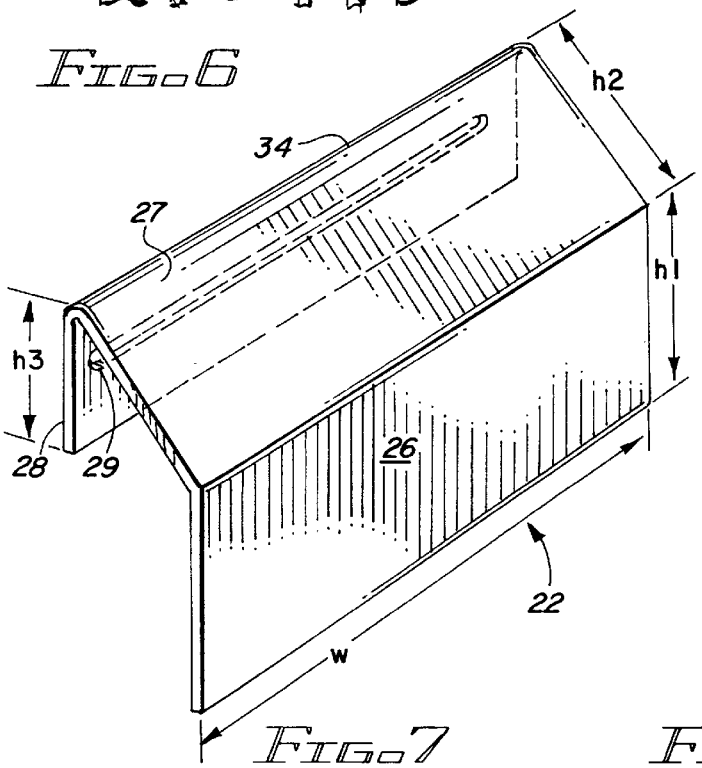
FIG. 7 is a perspective view of the adjustable metal haunch form of the invention.

The haunch form 22, as shown in the perspective view of FIG. 7 and in the cross-sectional view of FIG. 6, is fabricated from a rectangular sheet of ⅛ inch (11 gage) steel or other suitable material. In its finished configuration the form 22 has a stem wall face 26, a haunch face 27 and a fastener face 28. In its mounted position as shown in FIG. 6, the stem wall face 26 is vertically oriented for alignment with the side of the stem wall. The haunch face is canted away from the plane of the stem wall surface, preferably at an angle between 30 and 45 degrees. At the outer edge of the canted haunch face 27, the haunch form bends vertically downward to form the fastener face 28. A horizontal slot 29 or a string of horizontal slots cut into the fastener face 28 is employed in the mounting of the haunch form 22 to the stem wall form 23.

In the preferred embodiment of the invention, the width W of the form 22 is four or eight feet, the height h1 of the stem wall face 26 is approximately sixteen inches, the dimension h2 of the haunch face 27 is 7 and ¼ inches and the height h3 of the fastener face 28 is four inches. The fastener face and the stem wall face are spaced apart horizontally 4 and ⅛ inches.

The mounting and adjusting of the haunch form 22 at the top of the stem wall form 23 proceeds as follows:

The stem wall forms 23 are first set in place and suitably secured upon the forms that are employed for pouring the bottom bridge deck. The haunch form 22 is then positioned as shown in FIGS. 6 and 8 at the top of the stem wall form 23 with the stem wall face 26 of haunch form 22 resting against the plywood sheet 20. The haunch form is secured in this position by first passing a ½ inch threaded rod 30 through the space between each pair of adjacent stiffbacks 25 and through slot 29 of haunch form 22. This position is first loosely secured by means of a ½ inch nut 31 at the fastening face 28 and a ½ inch wing nut 32 at the opposite end of rod 30 over a 4 inch by 4 inch square metal plate washer 33. The position of the form 22 is then adjusted horizontally for alignment with the width dimension of the stem wall form and vertically for alignment with the desired grade level. The position of the form 22 is adjusted vertically by moving rod 30 up or down between the adjacent vertical stiffbacks 25 to align the upper edge 34 of haunch form 22 with the grade level 35. When horizontal and vertical aalignments are achieved the wing nuts 32 are tightened.

Upon completion of form erection and alignment adjustments and following the optional placement of reinforcing steel 36 the stem walls 37, and the haunches 38 are poured along with the bottom bridge deck and the tops of the stem walls and haunches are finished to the grade level 35.

Figure 9:
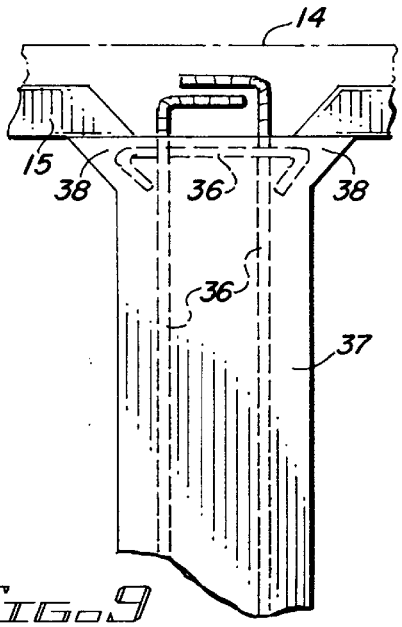
FIG. 9 is a cross-sectional view of a stem wall with integral concrete haunches that were poured using the adjustable metal haunch form of the invention.

After the poured concrete stem walls and the bridge deck have adequately set up, the stem wall forms 23 and the haunch forms 22 are removed, exposing the concrete stem walls 37 and the integral concrete haunches 38 as shown in FIG. 9. The lost deck panels 15 are then put in place with their ends resting directly upon the surfaces of the concrete haunches. No further adjustments are required prior to the pouring of road bed 14.

The placement and adjusting of the haunch form 22 is readily accomplished in a matter of minutes as compared with a considerably longer operation involved in the placement and adjustment of the prior art wooden haunches. A significant cost saving is thus realized by the reduction in construction labor. Even more significant material costs are realized by virtue of the fact that the adjustable haunch forms of the invention are reusable while the expensive 4×4 beams and metal hangers of the prior art wooden haunches are sacrificed after initial use.

Figure 10:
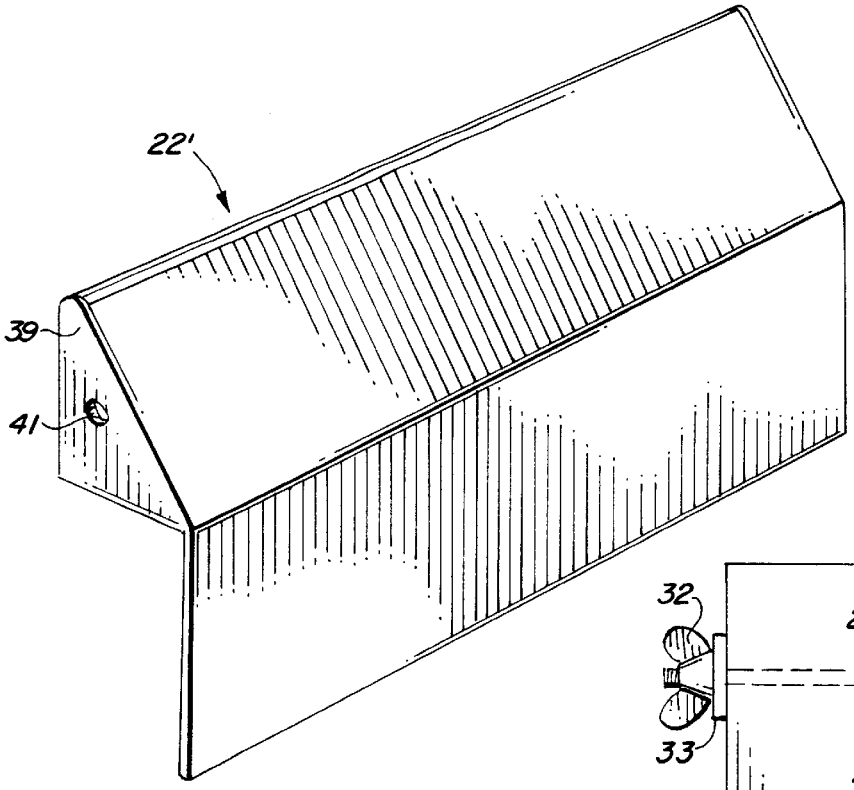
FIG. 10 is a perspective view of a second embodiment of the invention in which the upper ends of the haunch form are enclosed to permit bolting together the abutting ends of adjacent haunch forms.

In a second embodiment of the invention as shown in FIG. 10, the upper ends of the haunch form 22' are closed by a triangular end plate 39. The plate 39 abuts a corresponding plate 39 of an adjoining haunch form 22' (not shown) and is secured thereto by a bolt that passes through aligned central openings 41 in adjoining end plates 39.

Figure 11:
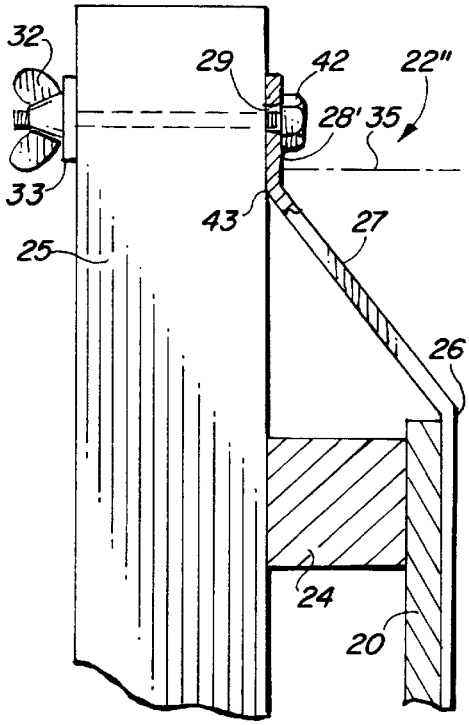
FIG. 11 is a cross-sectional view of another embodiment of the invention shown in place atop the stem wall form.

In a third embodiment of the invention as shown in FIG. 11, the haunch form 22" has a stem wall face 26 and a haunch face 27, both of which are identical with those of FIGS. 6, 7 and 8. The fastener face 28', however bends vertically upward from the upper edge 43 of the haunch face 27 rather than vertically downward.

The haunch form 22" is secured to the top of the stem wall forms by a bolt 42 (preferably a ½ inch bolt) that passes through a horizontal slot 29 of fastener face 28' and through the opening between adjacent vertical stiffbacks 25 of the stem wall forms. A wing nut 32 and a square metal washer 33 assembled to the opposite end of bolt 42 complete the set of mounting hardware for the haunch form 22".

The vertical positioning of the haunch form 22" is again set and adjusted to align the upper edge 43 of the haunch face 27 with grade level 35.

Figure 12:
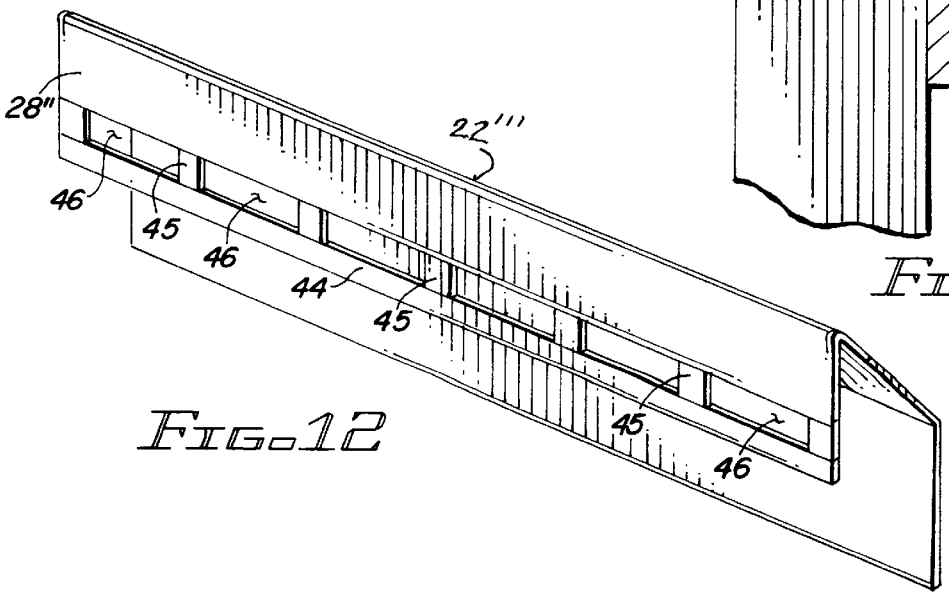
FIG. 12 is a perspective view illustrating a variation in the fabrication of the haunch form of FIG. 7.

The haunch form 22"' of FIG. 12 is identical with haunch form 22 of FIG. 7 except that it is fabricated in a different manner. In the case of form 22 of FIG. 7, the slot 29 was cut into the fastener face 28; in the case of the haunch form 22"' of FIG. 12, a metal strap 44 is secured at the lower edge of the upper portion of fastener face 28" by means of rectangular gussets or spacers 45. The openings 46 between the gussets 45 serve as slots for the threaded rod 30 that is employed for mounting.

The gussets 45 are joined to the strap 44 and to the lower edge of the upper portion of the fastener face 28" by welding.

It will now be recognized that a significant cost improvement may be realized in the construction of post tension box girder bridges through the use of the adjustable haunch forms of the invention in accordance with the stated objects of the invention.

Although but a few embodiments of the invention have been illustrated and described, it will be apparent to those skilled in the art that various changes and modifications may be made therein without departing from the spirit of the invention or from the scope of the appended claims.

What is claimed is:

1. A form for bridge building purposes, said form comprising:

a stem wall form, and a three dimensional metallic haunch form for mounting to said stem wall form, said stem wall form having a vertical flat inside surface, said haunch form comprising a first flat surface for positioning against the vertical flat surface of said stem wall form, a second flat surface extending angularly outwardly of said first flat surface of said haunch form, and a third flat surface extending parallel with said first flat surface, and a rod extending through said third flat surface of said haunch form for fastening said haunch form to said stem wall form, whereby when said haunch form is secured to the top of an associated stem wall form with said first flat surface being parallel to said stem wall form, said second flat surface extending outwardly and upwardly of said stem wall form and said third flat surface being fastened to said stem wall form concrete may be poured into said haunch form and into said stem wall form to form a unitary haunch structure.

2. The form set forth in claim 1 wherein:

said second flat surface extends outwardly of said first flat surface at an acute angle relative to said first surface.

3. The form set forth in claim 1 wherein:

said first flat surface is reinforced by stiffbacks.

4. The form set forth in claim 3 wherein:

said third flat surface is provided with a horizontal slot, said rod passing through said horizontal slot and between two adjacent stiffbacks, wherein said horizontal slot provides horizontal adjustability of said haunch form relative to said stem wall.

5. The form set forth in claim 4 wherein:

said rod passes between two adjacent vertical stiffbacks and is clamped to the outside surface of said adjacent stiffbacks thereby providing vertical adjustability of haunch form position.

* * * * *